United States Patent [19]

Martin

[11] Patent Number: 4,651,982

[45] Date of Patent: Mar. 24, 1987

[54] SHEET DISPENSING METHOD AND APPARATUS

[75] Inventor: Harvey G. Martin, West Sussex, England

[73] Assignee: De La·Rue Systems Limited, England

[21] Appl. No.: 772,351

[22] Filed: Sep. 4, 1985

[30] Foreign Application Priority Data

Sep. 6, 1984 [GB] United Kingdom ..... 8422507

[51] Int. Cl.[4] ..... B65H 5/06

[52] U.S. Cl. ..... 271/4; 271/263; 271/110

[58] Field of Search ..... 271/4, 9, 902, 263, 271/110, 111

[56] References Cited

U.S. PATENT DOCUMENTS 4,154,437 5/1979 Butcheck ..... 271/263 X
4,318,484 3/1982 Stiernspetz .
4,450,978 5/1984 Graef ..... 271/902 X
4,462,587 7/1984 Graef ..... 271/263
4,519,601 5/1985 Watanabe ..... 271/114

FOREIGN PATENT DOCUMENTS 1532019 11/1978 United Kingdom .

*Primary Examiner*—Richard A. Schacher
*Attorney, Agent, or Firm*—Ostrolenk, Faber, Gerb & Soffen

[57] ABSTRACT

A method and apparatus for dispensing sheets (2) from a store (1) is described. Single sheets are withdrawn from the store (1) by a friction feed roller (3) driven by a motor (5). Each sheet is fed to a transport path (17) defined by a pair of conveyors (15) driven by a motor (5'). The motor (5') is reversible so that the sheets can be fed either to an output station (19) or a reject position (20). The motor (5) is stopped as soon as the leading edge of a sheet has reached the transport path (17) so that no further sheets can be withdrawn from the store (1) until the sheet has been dispensed. A conventional doubles detect system determines whether a single sheet has been correctly withdrawn from the store (1).

11 Claims, 5 Drawing Figures

SHEET DISPENSING METHOD AND APPARATUS

BACKGROUND AND SUMMARY OF THE INVENTION

The invention relates to a method and apparatus for dispensing sheets, in particular bank notes, security documents and the like.

There is an increasing requirement, particularly in the retain area, for a bank note dispensing system which is simple, reliable, and secure. In the past, sheet dispensing methods and apparatus have involved complex feed systems involving pivoting conveyor belts and moving diverters and these systems are too expensive for use in a retail area such as a small shop.

In accordance with one aspect of the present invention, a method of dispensing sheets from a store comprises:

(a) withdrawing a single sheet from the store;
(b) feeding the withdrawn sheet to transport means;
(c) preventing further sheets from being withdrawn from the store;
(d) detecting whether a single sheet has been correctly fed to the transport means;
(e) causing the transport means to pass the sheet in a first direction to an output station or in a second, opposite direction to a reject position according to the result of the detection step; and,
(f) if a further sheet is to be dispensed, enabling a further sheet to be withdrawn from the store, and repeating steps (a) to (f) until the required quantity of sheets has been fed to the output station.

This method provides a very simple dispensing system which allows the reject function to be obtained at a very small incremental cost and with a high degree of reliability. Thus, the transport means is caused to feed the sheets singly either to the output station or in a reverse direction to the reject position which may conveniently be positioned in the store.

Typically, step (d) will comprise detecting whether two or more sheets have been withdrawn from the store together.

Preferably, the step (c) of preventing further sheets from being withdrawn from the store is carried out when a leading edge of a sheet is firmly gripped by the transport means. In this way, each sheet is positively moved either while being withdrawn from the store or by the transport means.

In accordance with a second aspect of the present invention, sheet dispensing apparatus comprises a sheet store; first feed means for withdrawing single sheets from the store and second feed means for feeding the sheets from the first feed means in a first direction to an output station, the arrangement being such that sheets are selectively fed to the first feed means; and first detection means for detecting an incorrect feed, the second feed means being reversible whereby, when an incorrect feed is detected, the or each incorrectly fed sheet is passed by the second feed means to a reject position.

The first and second feed means may be separately driven, the first feed means being selectively driven such that the first feed means is stopped as soon as a single sheet has been withdrawn from the store.

As an alternative to the use of two separately driven feed means, the first and second feed means may be provided by a common feed system, the apparatus further comprising a selectively operable solenoid pusher for pushing sheets in the store away from the feed system after a single sheet has been withdrawn from the store In both these cases, once a sheet has been withdrawn from the store, the feeding of further sheets from the store is prevented.

Conveniently, the sheet dispensing apparatus includes control means for controlling operation of the feed means in response to control signals representing the quantity of sheets which are to be dispensed. It is particularly convenient if the apparatus further comprises second detection means arranged to detect the presence of a sheet downstream of the first detection means when the sheet protrudes into the output station. This allows the apparatus to determine when a sheet has been dispensed. Preferably, the first detection means is positioned such that when the first detection means detects the leading edge of a sheet, the sheet has been withdrawn from the store. With this arrangement, further sheets may be prevented from being withdrawn from the store until an already withdrawn sheet has been removed from the second feed means either at the output station or when the sheet or sheets have been passed to the reject position.

Preferably, the first detection means is arranged to detect whether two or more sheets have been withdrawn from the store together. For example the first detection means may comprise a known doubles detect arrangement.

Preferably, the length of the second feed means is greater than the length of a sheet to be fed. This prevents a sheet from being inadvertently removed at the output station if it has been incorrectly fed and before the second feed means has been reversed to pass the incorrectly fed sheet to the reject position.

Conveniently, the sheet store is removable and may comprise a conventinal bank note cassette.

The dispensing apparatus could be arranged as a self-contained unit or it could be included as part of a conventional dispenser mechanism housed in a fixed secure container. In addition, the apparatus could be included in an automated cash dispensing mechanism including both a coin dispenser and, where necessary, a bank note/coin acceptor.

The output station of the sheet dispensing apparatus could be arranged adjacent to a conventional sheet presenter including, for example, a conventional stacking wheel so that a stack of sheets could be dispensed to a user.

BRIEF DESCRIPTION OF THE DRAWINGS

In order that the invention may be better understood, an embodiment of sheet dispensing apparatus in accordance with the invention will now be described with reference to the accompanying drawings, in which.

DETAILED DESCRIPTION OF THE PREFERRED EMBODIMENTS

Figure 1:
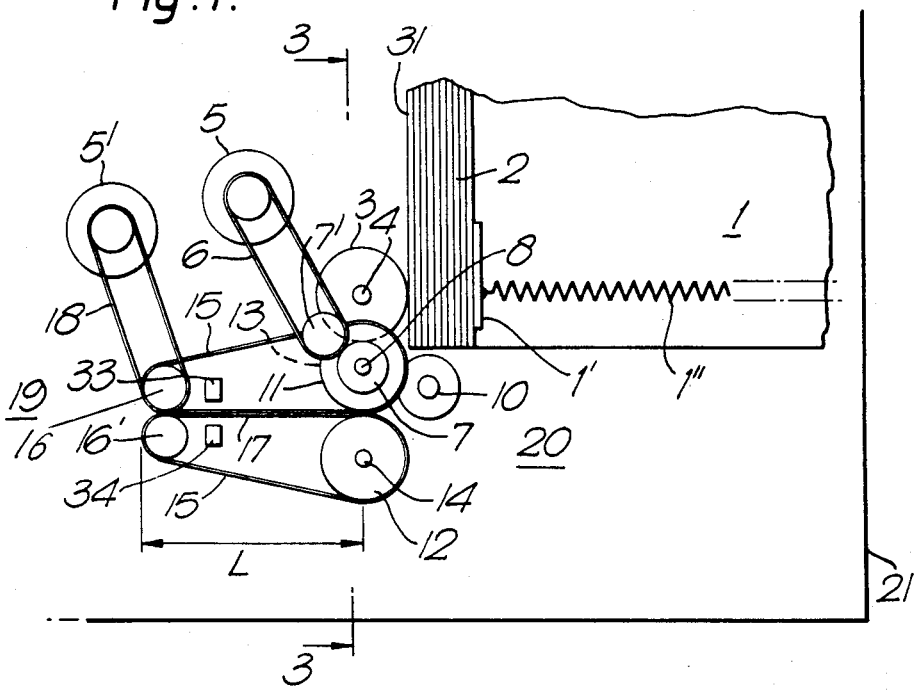
FIG. 1 is a schematic side view of the apparatus.
Figure 2:
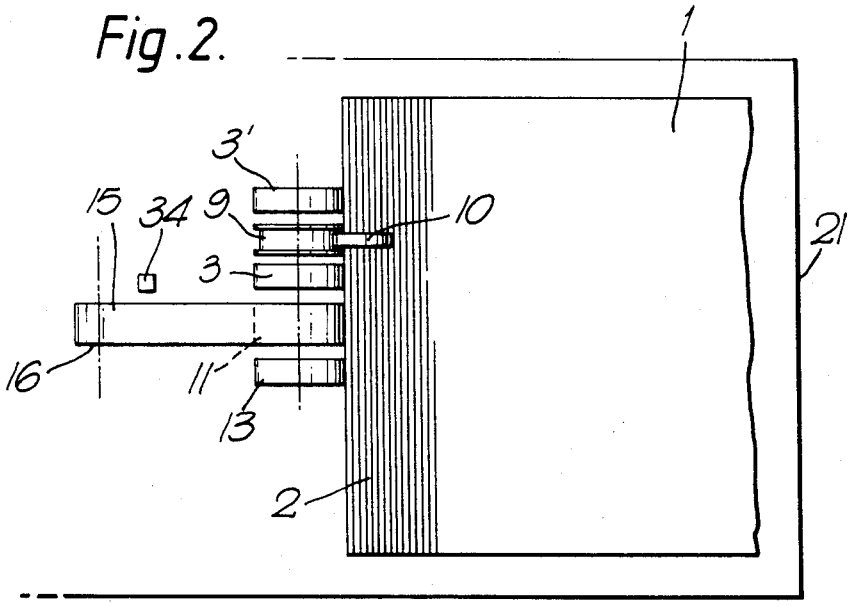
FIG. 2 is a schematic bottom plan.
Figure 3:
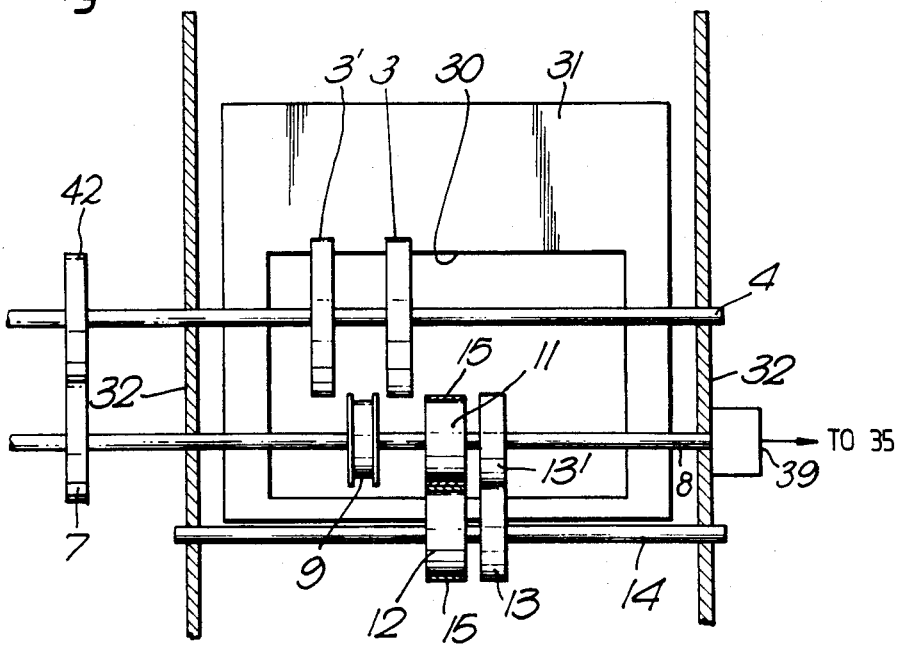
FIG. 3 is a view taken on the line 3—3 in FIG. 1.

The apparatus shown in FIGS. 1 to 3 is for dispensing single denomination bank notes such as sterling £1 notes contained in a conventional cassette 1. The bank notes 2 are pushed in a conventional manner by for example a plate 1' urged to the left as seen in FIG. 1 by a compression spring 1'' against a pair of friction feed rollers 3, 3' non-rotatably mounted on a shaft 4 through an aperture 30 (FIG. 3) in a front wall 31 of the cassette 1. The rollers 3 are driven by a low power stepper motor 5 via a drive belt 6 which is entrained about a roller 7' and engages a roller 7 rotatably mounted on a shaft 8. The roller 7 engages a drive roller 42 (FIG. 3) non-rotatably mounted on the shaft 4. For clarity, a majority of these rollers have been omitted in FIG. 2.

Rotation of the feed rollers 3 feeds a single sheet out of the cassette 1 and between a roller 9 rotatably mounted on the shaft 8 and a stationary roller 10. The rollers 9, 10 co-operate to try to ensure that only a single note passes through. In some cases, the roller 10 could be rotated in a direction opposite to the feed direction of the sheets to even out wear.

Each sheet is then fed between a pair of rollers 11, 12 and a pair of conventional doubles detect rollers 13, 13'. The rollers 11, 13' are mounted rotatably about the shaft 8 while the rollers 12, 13 are mounted rotatably about a shaft 14.

A pair of conveyor belts 15, 15' are mounted about the rollers 11, 12 and a pair of rollers 16, 16' to define a transport path 17. The transport system, comprising the belts 15, 15' and rollers 11, 12, 16, 16' is driven by another low power stepper motor or by a DC motor 5' via a drive belt 18.

The doubles detect rollers 13,13' operate in a conventional manner to detect the passage of notes between them and provide output signals which vary in accordance with their separation. For example, the doubles detect rollers may operate in a similar way to that described in EP-A-No. 0130824 which is incorporated herein by reference. In this case an LED and photodetector (not shown) are mounted within the shaft 8 and a varying electrical signal is generated by the photodetector corresponding to the passage of sheets through the nip defined by the rollers 13, 13'. This electrical signal is fed to processing electronics 39 which generates a corresponding signal fed to a microcomputer 35.

The apparatus is controlled by a mini or micro computer 35 which is responsive to output signals from the doubles detect system to determine whether or not a single bank note has been correctly fed and to other signals to be described below.

The various rollers described are mounted on shafts (some of which are shown in the drawings) extending between side walls 32, 32' of the dispenser.

In use, a user indicates to the computer 35 the quantity of bank notes which are to be dispensed, via a conventional key pad 36 and display 37 in a front panel 38 of a presenter 22. In response to this instruction, the computer 35 causes actuation of the motors 5, 5'. The motor 5 causes the feed rollers 3 to rotate and to withdraw a single sheet from the cassette 1 which is fed between the rollers 9, 10 and then into the nips defined between the rollers 11, 12 and the doubles detect rollers 13,13'. As soon as the doubles detect system senses the leading edge of the note it provides a corresponding output signal which is fed to the computer 35 which in turn deactivates the motor 5 so that no further notes are withdrawn from the cassette 1 by the feed rollers 3. If the doubles detect system indicates to the computer that a single note has been correctly fed, the motor 5' will continue to rotate so that the note is drawn along the transport path 17. Assuming that a single note is being fed along the transport path 17, the computer causes the motor 5' to stop at a predetermined time interval after the leading edge of the note has been detected by the doubles detect system at which point a leading portion of the note protrudes beyond the roller 16 into an output station 19. The user can then pull the note out of the apparatus.

Further detection means such as a LED 33 and photodetector 34 are provided at a position laterally offset from the belts 15 such that when a sheet protrudes into the output station 19 the detection means senses a trailing portion of the sheet. Once the sheet has been removed from the transport path 17 the detection means indicates to the computer 35 that the trailing portion is no longer sensed and, if further sheets are to be dispensed, the computer 35 will reactuate the motors 5, 5' and the process will be repeated.

If the doubles detect system senses an incorrect feed, for example two or more notes have been fed simultaneously, the computer will continue actuation of the motor 5' until the incorrectly fed notes are drawn into the path 17 but have not protruded into the output station 19. This situation occurs as soon as the doubles detect rollers 13,13' fail to sense the presence of a note therebetween. At this point, the motor 5' is stopped and reversed so that the motion of the drive belts 15 is reversed and the incorrectly fed notes are passed into a reject position which is conveniently defined by a dump cassette 20. In an alternative arrangement (not shown) the rejected sheets are fed back to another (dump) part of the cassette 1. In order for there to be no risk of incorrectly fed notes being withdrawn at the output station, it is convenient if the length L of the transport path 17 is greater than the length of the notes being fed.

The dispensing apparatus will be housed in a secure container 21 in a conventional manner and the container 21 can be provided with suitable locking devices so that it can be mounted to a fixed base. The apparatus is connected to the conventional presenter 22 as indicated in block diagram form in FIG. 4.

Figure 4:
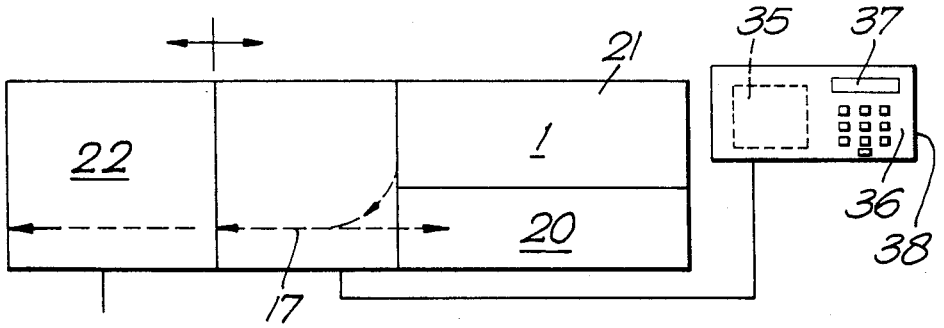
FIG. 4 illustrates diagrammatically the apparatus of FIGS. 1 to 3 in conjunction with a presenter; and, FIG. 5 is a schematic bottom plan of a modification of the embodiment shown in FIGS. 1 to 3.

FIG. 4 illustrates in diagram form how such apparatus would be arranged and the presenter 22 could include a conventional stacker wheel so that single notes fed to the output station 19 will be stacked by the wheel.

As can be appreciated, this apparatus is particularly compact in view of the short length of the transport path 17 and the short distance travelled by the notes from the cassette 1 to the transport path 17 and further simplification is achieved since no movable diverter is required, incorrectly fed notes being fed to the reject position 20 simply by reversing the direction of movement of the belts 15.

Figure 5:
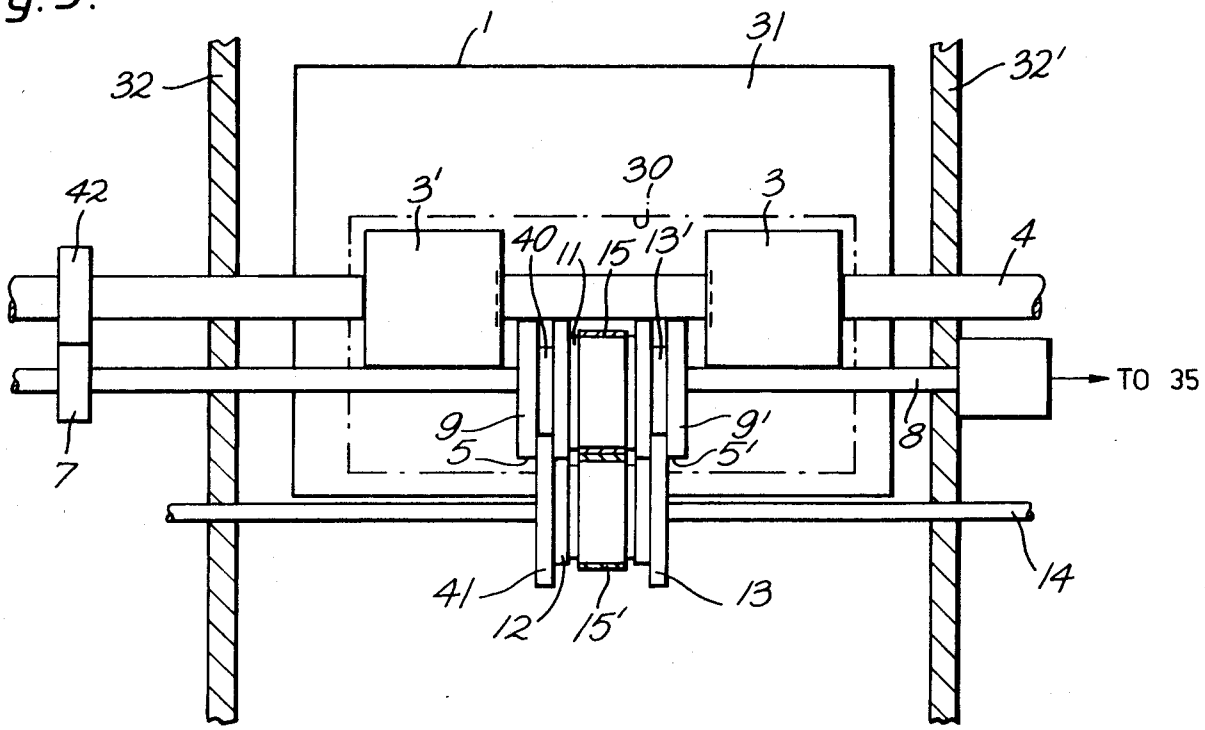

FIG. 5 is a view similar to FIG. 3 but illustrating a modified embodiment in which the various rollers are centralised. In FIG. 5, those elements which correspond to elements in FIG. 3 have been given the same reference numerals. The modifications are of a minor nature as follows. Instead of a single roller 9, two rollers 9, 9' are rotatably mounted on the shaft 8 and cooperate with respective stationary rollers (not shown) corresponding to the stationary roller 10 in the main embodiment. The cooperating pairs of rollers including the rollers 9, 9' are provided to try to ensure that only a single note is fed from the cassette 1. In addition, a pair of rollers 40, 41 are rotatably mounted on the shafts 8, 14 respectively to act as guide rollers.

This modification operates in a similar way to the main embodiment previously described.

I claim:

1. A method of dispensing sheets from a store, the method comprising:

(a) attempting to withdraw a single sheet from said store;

(b) feeding said withdrawn sheet to transport means;

(c) preventing further sheets from being withdrawn from said store;

(d) detecting whether a single sheet has been correctly fed to said transport means;

(e) causing said transport means to pass said withdrawn sheet in a first direction to an output station or in a second direction to a reject position according to the result of said detection step; and, (f) if a further sheet is to be dispensed, enabling a further sheet to be withdrawn from said store, and repeating said steps (a) to (f) until the required quantity of sheets has been fed to said output station.

2. A method according to claim 1, wherein said step (d) comprises detecting whether two or more sheets have been withdrawn from said store together.

3. A method according to claim 1, wherein said sheet defines a leading edge, and wherein said step (c) is carried out when said leading edge of a sheet is firmly gripped by said transport means.

4. A method according to claim 1, wherein said first and section directions are opposite to one another.

5. Sheet dispensing apparatus comprising: an output station; a reject position; a sheet store; first feed means for intermittently attempting to withdraw single sheets from said store; first detection means for detecting whether a single sheet has been correctly fed; second feed means for feeding said withdrawn sheet from said first feed means to said output station when said first detection means determines that a single sheet has been correctly fed and for feeding said withdrawn sheet to said reject position when said first detection means determines that said withdrawn sheet has not been correctly fed, said first feed means delaying the withdrawing of each consecutive said sheet from said store until the immediately preceding said sheet has been fed to either said output station or said reject position.

6. Apparatus according to claim 5, wherein said first and second feed means are separately driven, said first feed means being selectively driven such that said first feed means is adapted to be stopped as soon as a single sheet has been withdrawn from said store.

7. Apparatus according to claim 5, further including control means for controlling operation of said feed means in response to control signals representing the quantity of said sheets which are to be dispensed.

8. Apparatus according to claim 5, further comprising second detection means arranged to detect the presence of a sheet downstream of said first detection means when said sheet protrudes into said output station.

9. Apparatus according to claim 5, wherein said first detection means is adapted to detect whether two or more sheets have been withdrawn from said store together.

10. Apparatus according to claim 5, wherein said first detection means is positioned such that when said first detection means detects said leading edge of a sheet, said sheet has been withdrawn from said store.

11. Apparatus according to claim 5, wherein the length of said second feed means is greater than the length of a sheet to be fed.

* * * * *